US005865648A

United States Patent [19]

Clyatt, III

[11] Patent Number: 5,865,648

[45] Date of Patent: Feb. 2, 1999

[54] MULTIFUNCTION ELECTRONIC CONNECTOR

[75] Inventor: Clarence L. Clyatt, III, Goodyear, Ariz.

[73] Assignee: Elco U.S.A. Inc., Myrtle Beach, S.C.

[21] Appl. No.: 784,799

[22] Filed: Jan. 16, 1997

[51] Int. Cl.[6] ..... H01R 13/66

[52] U.S. Cl. ..... 439/620; 439/289

[58] Field of Search ..... 439/79, 620, 289

[56] References Cited

U.S. PATENT DOCUMENTS

| | | | |
|---|---|---|---|
| 4,726,790 | 2/1988 | Hadjis | 439/620 OR |
| 4,729,743 | 3/1988 | Farrar et al. | 439/276 |
| 4,781,624 | 11/1988 | Shepherd | 439/620 |
| 4,804,332 | 2/1989 | Pirc | 439/620 |
| 4,929,196 | 5/1990 | Ponn et al. | 439/620 |
| 5,057,041 | 10/1991 | Yu et al. | 439/620 |
| 5,094,629 | 3/1992 | Black et al. | 439/620 |
| 5,102,354 | 4/1992 | Crane et al. | 439/620 |
| 5,112,253 | 5/1992 | Swift | 439/620 |
| 5,147,223 | 9/1992 | Black et al. | 439/620 |
| 5,151,054 | 9/1992 | Briones et al. | 439/620 |
| 5,152,699 | 10/1992 | Pfeifer | 439/620 |
| 5,158,482 | 10/1992 | Tan et al. | 439/620 |
| 5,213,522 | 5/1993 | Kojima | 439/620 |
| 5,224,878 | 7/1993 | Lurie et al. | 439/620 |
| 5,266,054 | 11/1993 | Duncan et al. | 439/620 |
| 5,286,221 | 2/1994 | Fencl et al. | 439/620 X |
| 5,344,342 | 9/1994 | Briones | 439/620 |
| 5,397,250 | 3/1995 | Briones | 439/620 |
| 5,415,569 | 5/1995 | Colleran et al. | 439/620 |
| 5,624,277 | 4/1997 | Ward | 439/620 OR |

*Primary Examiner*—Neil Abrams
*Assistant Examiner*—Daniel Wittels
*Attorney, Agent, or Firm*—Dority & Manning, P.A.

[57] ABSTRACT

In a multifunction electronic connector, spring loaded contacts are eliminated in favor of conductive bonds or terminations using solder, conductive adhesive, conductive epoxy or the like. Electronic components, which may comprise capacitors, resistors, inductors, varistor components or other passive or active components or combinations thereof, are disposed within cavities in an insulating housing so that terminals at first ends thereof are in direct contact with and are conductively bonded to a plurality of contacts disposed within apertures in the housing. At the same time, terminals at the opposite ends of the components also make direct contact with and are conductively bonded to a terminal member mounted at the bottom of the body. Where the circuit configurations of the connector require, the ends of the contacts are formed into contact tails which extend into contact with and are conductively bonded to other portions of the terminal member. The terminal member may comprise a planar substrate which is generally parallel with the contacts, and the portion thereof in contact with the lower terminals of the electronic components may comprise an electrical grounding member. Alternatively, the grounding member may comprise a separate ground plane soldered or otherwise conductively bonded to the substrate and having compliant beams extending upwardly therefrom and into contact with the lower terminals of the electronic components.

29 Claims, 5 Drawing Sheets

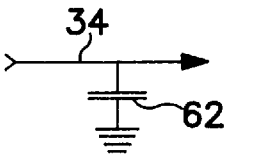
FIG. 7
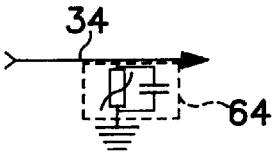
FIG. 8
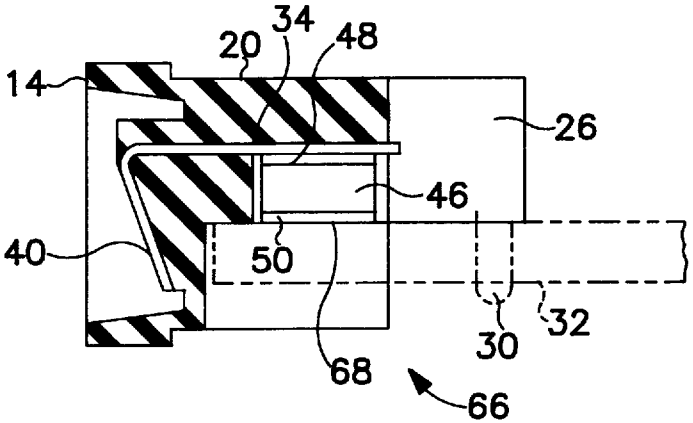
FIG. 9
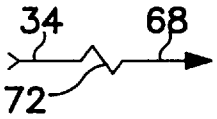
FIG. 10
FIG. 11
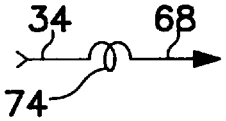
FIG. 12

MULTIFUNCTION ELECTRONIC CONNECTOR

BACKGROUND OF THE INVENTION

1. Field of the Invention

The present invention relates to electrical connectors, and more particularly to connectors in which electronic components such as chip capacitors are coupled in circuit with a plurality of contacts so as to provide the connector with capacitive filters or the like.

2. History of the Prior Art

Electronic connectors are well known and are widely used in a variety of different electrical connection applications. Typically, such connectors include an insulative body which mounts a plurality of contacts in conjunction with electrical components such as capacitors or other such components. Where capacitors are used, such components which may comprise electronic chip capacitors are coupled in circuit with the contacts to form capacitive filters. The connector may be assembled within a plug cover together with a plug assembly having a plurality of spring contacts to form an integral plug connector for various electrical and electronic connection applications.

In electronic connectors of the type described, electrical interconnections of the capacitors or other electronic components with the contacts of the connector are typically accomplished using resilient spring contacts or other interconnections. The components may be connected by leads extending from the component to the associated contact and to an adjacent ground plane or other ground member on a substrate. The chips may be assembled onto individual contacts to form contact subassemblies, with the subassemblies then being inserted into connector assemblies with internal or integral ground planes. Alternatively, contacts may be installed perpendicularly into one or more substrate capacitors to make a contact/substrate assembly which is installed and grounded into a connector shell.

Electronic connectors of this type enjoy various advantages over connectors of earlier and more rudimentary design. Such advantages derive from features such as the relocation of the electronic components from the system boards of prior arrangements into the connector envelope. Unwanted electrical signals are more effectively controlled at the connector interface rather than within the system, and this reduces or eliminates the need for redundant protective components. Such connector arrangements permit the use of different components to achieve different functions. Typically, such connectors utilize an insulative housing or body, the outside surface of which may be metallized to improve protection from radiated EMI/RFI. In some cases, the designs may allow for fully automated assembly, testing, packaging and integration with a customer's system.

Examples of prior art electronic connectors are provided by U.S. Pat. No. 5,151,054 of Briones et al., U.S. Pat. No. 5,397,250 of Briones, U.S. Pat. No. 5,344,342 of Briones, U.S. Pat. No. 5,152,699 of Pfeifer, U.S. Pat. No. 5,057,041 of Yu et al., U.S. Pat. No. 5,112,253 of Swift, U.S. Pat. No. 5,213,522 of Kojima, U.S. Pat. No. 5,158,482 of Tan et al., U.S. Pat. No. 5,102,354 of Crane et al., and U.S. Pat. No. 4,729,743 of Farrar et al. These patents show that it is well known to incorporate an electronic component, such as a chip filter capacitor, between a contact and a ground plane within a connector. The patents illustrate the many different approaches that have been taken to implement electronic connectors of this type. However, with a few exceptions, such connector arrangements rely on spring-loaded elements to make electrical contact between the component and the associated electrical contact or ground plane.

Typical of the prior art electronic connector arrangements requiring spring-loaded or resilient elements to achieve electrical interconnection is the '054 patent of Briones et al. In the described arrangement, the electronic components require spring biasing force from tabs on the ground spring to maintain electrical contact with the connector contacts and with the ground spring. The ground springs are on outer surfaces of an insulator housing, and the ground path for all components is through the ground springs to flanges at each end of the connector. The ground path varies according to component location. A shell is provided by the ground springs or other separate conductive components. The contacts and the ground plane or ground springs are terminated in separate operations. The ground spring flanges are sandwiched between an insulator housing flange and a mating connector or other electrical device. The insulator housing is comprised of two or more components, and accommodates a single electronic component in each cavity therein. Consequently, the connector assembly has five components, plus contacts, and the electronic components.

Principally due to the need for resilient or spring-loaded contacts in many prior art connector arrangements, such as that exemplified by the '054 patent of Briones et al., such connector arrangements tend to be complex, difficult to assemble, and expensive overall. For example, contacts which are resilient or spring-loaded are typically more expensive to manufacture than are non-resilient contact members. Moreover, the use of spring-loaded or resilient interconnections increases the number of component parts required in the connector assembly. This adds to the expense and the difficulty of assembly of the connector. Moreover, the lack of direct contact between basic components such as the terminals of the electronic components and the contacts and the ground planes or other conductive members often produces certain electrical problems which may require compensation, at added complexity and expense.

Consequently, it would be desirable to provide an improved electronic connector of relatively simple, reliable and inexpensive design. It would further be desirable to provide a connector having fewer parts than the typical connector arrangements of the prior art, and one in which relatively inexpensive non-resilient members may be used. Still further advantages could be derived from an improved electronic connector in which the nature of the interconnection of the component parts thereof provides for increased reliability and more consistent performance.

BRIEF DESCRIPTION OF THE INVENTION

The foregoing and other objects and features are accomplished in accordance with the invention by an improved electronic connector in which spring-loaded contacts are eliminated in favor of conductive bonds of direct terminations using solder, conductive adhesive, conductive epoxy, or the like, resulting in simple and inexpensive connectors having low contact impedances. In electronic connectors according to the invention, the terminals of the electronic components terminate in direct contact with, and are conductively bonded with, the contacts of the connector. Opposite terminals of the components terminate in direct contact with, and are conductively bonded to, a terminal member such as a substrate or conductive ground plane opposite the contacts. The conductive bonding is accomplished using solder, conductive adhesive, conductive epoxy or the like.

In a preferred embodiment of an electronic connector according to the invention, an insulative housing of elongated configuration has contacts extending through a plurality of contact apertures therein, to mount the contacts within the housing and form a contact bank at a front of the housing. At an opposite rear of the housing, cavities extend downwardly from the contacts, and receive electronic components, such as chip capacitors, therein. Each component has an upper terminal which terminates in direct contact with an associated one of the contacts and is conductively bonded thereto. Opposite terminals at the lower ends of the electronic components terminate in contact with, and are conductively bonded to, an adjacent portion of a substrate mounted at the underside of the connector housing. The substrate forms a terminal member, and the portion thereof in contact with the lower terminals of the electronic components may comprise a grounding portion or member where the circuit configuration calls for grounding of such terminals. The grounding portion or member may simply comprise a portion of the substrate. Alternatively, the grounding portion may comprise a conductive ground plane of planar configuration conductively bonded to the lower terminals of the electronic components, and itself conductively bonded to the substrate. Where the circuit configuration of the connector requires, the ends of the contacts at the rear of the housing are formed into contact tails which extend downwardly and terminate in contact with the substrate, where they are conductively bonded.

Electronic connectors in accordance with the invention are of simple configuration and involve fewer parts than most prior art electronic connectors. The capacitor or other electronic component is sandwiched between the ground plane or other terminal member of generally planar configuration and intermediate portions of the associated contacts which are parallel with the terminal member. Where a ground plane is used, the lower surface of the ground plane is generally coplanar with the tail portions of the contacts residing on the surface of the substrate. A separate ground plane can be conductively bonded to the substrate such as by soldering at multiple points. The need for spring-loaded contacts is eliminated. Instead, the contacts can be fabricated from relatively inexpensive fingers of soft annealed composition, which are simply soldered to the adjacent terminals of the electronic components. The soldering can be accomplished by presoldering, followed by IR reflow soldering. Contact impedances are minimized.

In electronic connectors according to the invention, lead inductance between the electronic components and the contacts is minimized by terminating the component directly at the contact. By soldering components such as chip capacitors of generally rectangular shape, the series resistance is minimized when compared with the use of spring contact force as the termination, for the same component. Consequently, inexpensive connector components can be used, and this reduces the cost and assembly time of the connector. At the same time, the reliability of the connector is improved over prior art designs. The elimination of subassemblies and the use of standard electronic components minimizes assembly risk and the cost of scrapping, when compared with the more complex connector configurations of the prior art. The electrical path through the components from the contacts to ground is the same for all contact locations, and consequently consistent line-to-line performance is achieved. Assembly of the connector may be fully automated.

BRIEF DESCRIPTION OF THE DRAWINGS

The foregoing and other objects of the invention as well as its operating advantages will be apparent from the description of preferred embodiments with reference to the accompanying drawings, in which:

FIG. 7 is a schematic circuit diagram of the connector of Fig. 1, when provided with capacitors so as to function as capacitive filters;

FIG. 8 is a schematic circuit diagram of the connector of FIG. 1, when provided with varistor components;

FIG. 9 is an end view of a connector embodiment which is similar to that shown in FIG. 6, but in which the contacts do not terminate on the substrate;

FIG. 10 is a schematic circuit diagram of the connector of FIG. 9, when provided with capacitors so as to form series capacitance circuits;

FIG. 11 is a schematic circuit diagram of the connector of FIG. 9, when provided with resistors so as to form series resistance circuits;

FIG. 12 is a schematic circuit diagram of the connector of FIG. 9, when provided with inductors so as to form series inductance circuits;

DETAILED DESCRIPTION OF THE EMBODIMENTS

Figure 1:
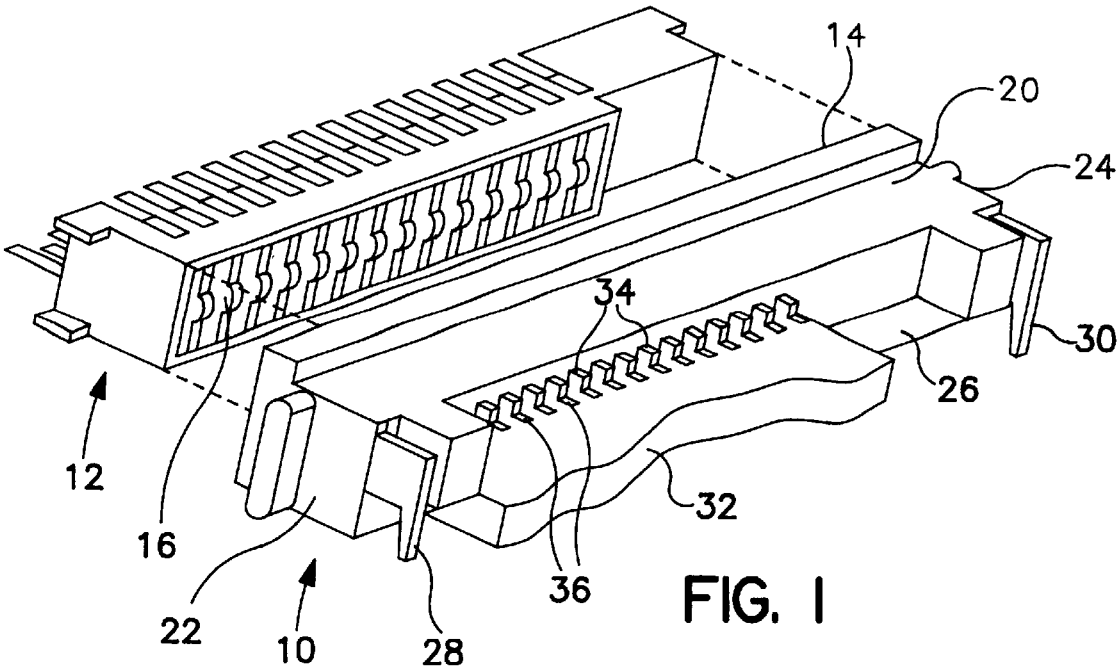
FIG. 1 is a perspective view of a multifunction electronic connector in accordance with the invention, shown in conjunction with an associated plug assembly.
Figure 2:
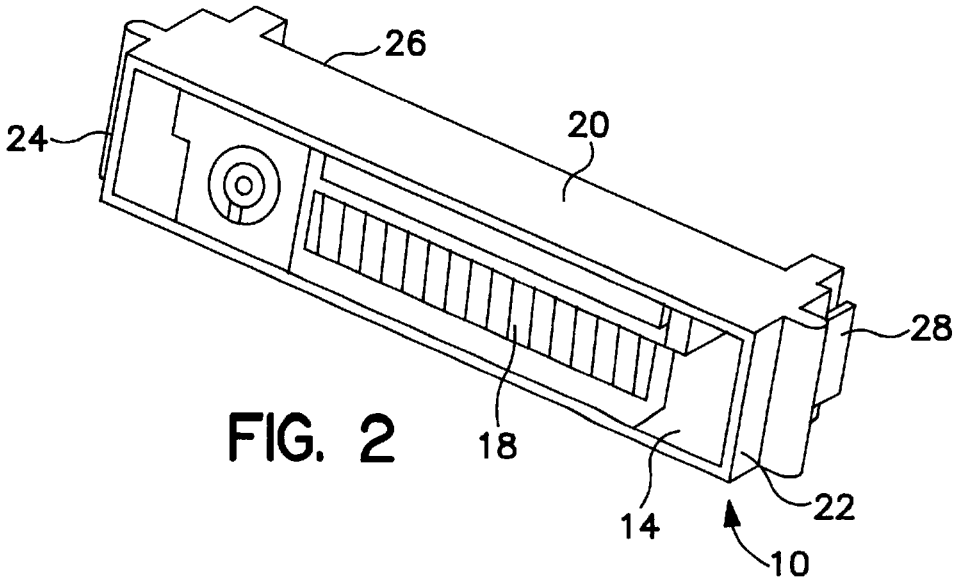
FIG. 2 is a different perspective view of the electronic connector of FIG. 1, showing the front of the connector.

FIG. 1 shows a multifunction electronic connector 10 in accordance with the invention. The connector 10 is shown in conjunction with a conventional plug assembly 12. The plug assembly 12 is received within a front 14 of the connector 10 to form a connector assembly, in well known fashion. Contact interconnections between the connector 10 and the plug assembly 12 are provided by a plurality of spring contacts 16 disposed along the plug assembly 12. The spring contacts 16 engage individual ones of a contact bank 18 of the connector 10, when the plug assembly 12 is installed at the front 14 of the connector 10. The contact bank 18 is shown in the view of FIG. 2. The plug assembly 12 may be mounted in a plug cover assembly for applications where the plug is on the end of a cable.

The connector 10 includes an insulative body 20 of elongated configuration between opposite ends 22 and 24 thereof. The exterior shape of the body 20 is of conventional configuration, and defines the front 14 and an opposite rear 26 of the connector 10. The body 20 has the same exterior shape as a MOBO 9157 SMT socket connector manufactured by Elco Corporation. The front 14 and the rear 26 extend in the direction of elongation of the connector 10 between the opposite ends 22 and 24. A pair of locating pins 28 and 30 are mounted on the body 20 at the opposite ends 22 and 24 thereof to facilitate mounting of the connector 10 onto a PC board (or other substrate). A substrate 32 in the form of a PC board is mounted at the bottom of the body 20 so as to extend across a major portion of the length of the body 20 between the opposite ends 22 and 24 thereof.

As described in greater detail hereafter, a plurality of contacts 34 are mounted within the body 20 in generally parallel, spaced-apart relation across a major portion of the length of the body 20 between the opposite ends 22 and 24 thereof. In one embodiment of the connector 10, each of the contacts 34 ends in a contact tail 36 which terminates on the surface of the substrate 32.

Figure 3:
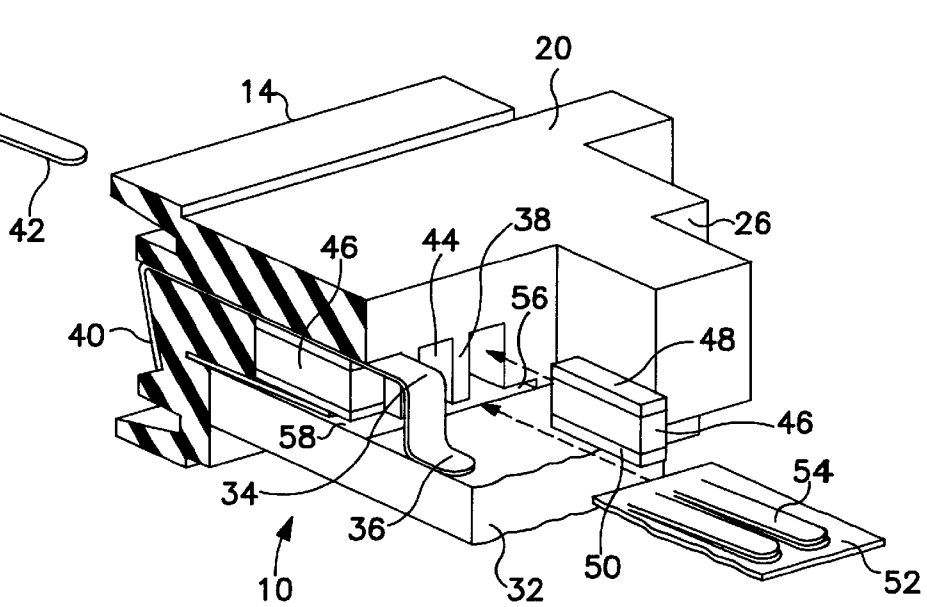
FIG. 3 is perspective, broken away view of a portion of the connector of FIG. 1, in accordance with a first embodiment thereof, showing the positioning of a ground plane in conjunction with a substrate, an electronic component and the contacts of the connector.
Figure 4:
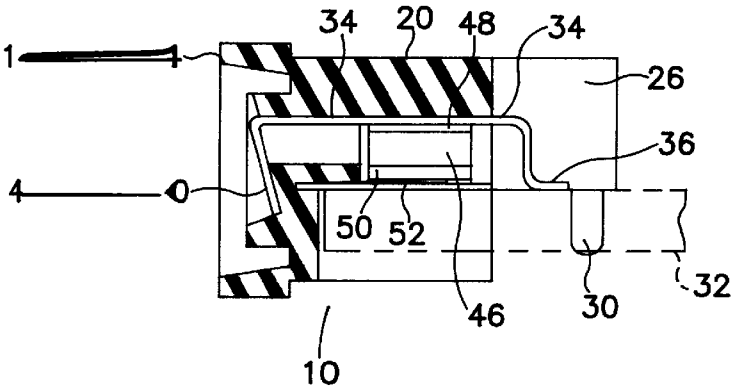
FIG. 4 is an end view of the connector of FIG. 3.

FIGS. 3 and 4 show the connector 10 of FIGS. 1 and 2 in greater detail, including the direct terminations with conductive bonds in accordance with the invention. The body 20 is provided with a plurality of contact apertures 38 which are in the form of generally parallel, spaced-apart slots extending between the front 14 and the rear 26 of the body 20. The contacts 34 are in the form of elongated, relatively flat conductive fingers, with one of the contacts 34 being shown in FIG. 3 outside of and adjacent to the front 14 of the body 20. Each contact 34 has a bent down front portion 40 thereof and an opposite rear portion 42 thereof. A different contact 34 is installed within each of the contact apertures 38 by inserting the rear portion 42 thereof in the contact aperture 38 and sliding the contact 34 through the body 20 until the front portion 40 resides against the front 14 of the body 20. The rear portion 42 of the contact 34 is then bent downwardly and outwardly so as to form a generally right angle foot which defines the contact tail 36 of the contact 34. The contact tail 36 is disposed in direct contact with the substrate 32 at the upper surface thereof. As described hereafter in connection with the alternative embodiments of FIGS. 9 and 15, each contact 34 may be terminated at the end of the contact aperture 38 adjacent to the rear 26 of the body 20 so that no contact tail 36 is formed.

In addition to the contact apertures 38, the body 20 is formed with a plurality of vertical cavities 44 at the rear 26 thereof. The cavities 44 are of generally rectangular configuration, and each extends downwardly from a portion of a different one of the contact apertures 38 to a lower end thereof at the bottom of the body 20 adjacent the upper surface of the substrate 32. Each cavity 44 is configured to receive a different electronic component 46 which is also of generally rectangular configuration and of similar size. The electronic component 46, which may comprise a chip capacitor or the like, has upper and lower terminals 48 and 50 at opposite upper and lower ends thereof respectively. Each of the terminals 48 and 50 presents a relatively flat surface extending along the length of the electronic component 46. When the electronic component 46 is installed in the associated cavity 44, the upper terminal 48 extends into direct contact with an intermediate portion of an associated contact 34 within the contact aperture 38 located immediately above the cavity 44. The upper terminal 48 is thus terminated in direct contact with the associated contact 34, and is conductively bonded thereto such as by soldering. The elongated flat surface of the upper terminal 48 contacts a mating part of the intermediate portion of the associated contact 34. At the same time, the lower terminal 50 of the electronic component 46 is disposed adjacent to the upper surface of the substrate 32 when the electronic component 46 is installed within the mating cavity 44.

The electronic component 46 may comprise a capacitor, an inductor, a resistor, a transguard/staticguard component, or other passive or active component. As described in detail hereafter in conjunction with various different embodiments, the electronic components 46 may be mounted singularly or in pairs within the cavities 44 in the body 20 to form a variety of different circuits in conjunction with the contacts 34.

In the embodiment shown in FIGS. 3 and 4, the connector 20 is provided with a conductive ground plane member 52, which is of relatively flat and generally planar configuration. The ground plane member 52 is cut so as to form a plurality of upstanding compliant beams 54. The body 20 is provided with opposite slots for receiving the ground plane member 52 at the underside thereof. One such slot 56 is shown in FIG. 3. Disposition of the ground plane member 52 within the opposite slots positions the ground plane member 52 against the lower terminals 50 of the electronic components 46, and at the same time on the upper surface of the substrate 32. This terminates the lower terminals 50 of the electronic components 46 in direct contact with the ground plane member 52, and the termination is completed by conductive bonding such as soldering, as described hereafter. The compliant beams 54 hold each electronic component 46 in place under slight preload until soldering is completed, and protect them from mechanically and thermally induced stresses due to handling or application. At the same time, the conductive ground plane member 52 is electrically coupled to a grounding portion of the substrate 32 formed at the upper surface thereof beneath the cavities 44.

As previously described in connection with FIGS. 3 and 4, the embodiment of the connector 10 shown therein is assembled, starting with provision of the body 20 having the contact apertures 38 and the cavities 44 therein. The contacts 34 are inserted into the contact apertures 38, and the electronic components 46 are inserted in the cavities 44. The ground plane member 52 is then installed at the bottom of the body 20 by insertion in the opposite slots, including the slot 56 shown in FIG. 3. When so inserted, a different compliant beam 54 of the ground plane member 52 engages the lower terminal 50 of each electronic component 46. The substrate 32 is then mounted at the underside of the body 20, so that the upper surface thereof engages the ground plane member 52. In the particular embodiment of FIGS. 3 and 4, the contacts 34 are provided with the contact tails 36. The contact tails 36 are formed by bending the rear portions 42 of the contacts 34 into the generally right angle shape shown so that the contact tails 36 reside on the upper surface of the substrate 32. The upper and lower terminals 48 and 50 of the electronic component 46 terminate in direct contact with the contacts 34 and the ground plane member 52 respectively, where they are conductively bonded using solder, conductive adhesive, conductive epoxy or the like. Soldering is the preferred form of conductive bonding, and may be carried out by presoldering each contact 34 to the upper terminal 48 of a different one of the electronic components 46, with the other direct terminations also being presoldered. After assembly of the connector 10, the soldered junctions are reflowed (this can be done in a variety of ways) to complete the soldered junctions. The lower terminal 50 of each electronic component 46 is soldered to the ground plane member 52, according to the particular application. The ground plane member 52 is conductively bonded to the grounding portion 58 at the upper surface of the substrate 32, again preferably by soldering at a plurality of different locations on the ground plane member 52. Each of the contact tails 36 is terminated directly on the upper surface of the substrate 32 by soldering or other conductive bonding.

By terminating the various contacts and terminals of the connector 10 in direct contact with each other and using conductive bonding such as soldering, in accordance with the invention, a number of advantages are realized. For one thing, a greatly simplified and inexpensive connector 10 is provided. By eliminating the resilient, spring-loaded contacts present in most prior art connector designs, the number of parts required within the connector is considerably reduced, and the design is simplified. Also, by eliminating the need for resilient, spring-loaded contacts, components such as the contacts 34 may be made of inexpensive materials such as soft annealed metal. With the resulting connector design, contact impedances are minimized, as are lead inductances between the electronic components and the contacts. By solder-terminating the electronic component 46 to each contact and to ground, series resistance is minimized. Subassemblies are not needed. Electronic components 46 of standard design and configuration can be used, and this minimizes the risk of assembly and the cost of occasionally having to scrap poor assemblies.

As shown in FIG. 4, the intermediate portion of each contact 34 is mounted in generally parallel relation to the ground plane member 52 and the upper surface of the substrate 32, with the electronic components 46 being sandwiched therebetween. Consequently, the electrical path through the components 46 from the contacts 34 to the ground provided by the ground plane member 52 is the same for all contact locations, and consistent line-to-line performance is thereby realized. While the contact tails 36 are shown in a generally right angle bend configuration in FIGS. 3 and 4, other configurations of the tails 36 are possible, so long as a terminating portion thereof terminates in direct contact with and can be conductively bonded to an appropriate portion of the substrate 32. As shown and described in connection with the embodiments of FIGS. 9 and 15 hereafter, certain of the circuit configurations eliminate the contact tails 36.

Figure 5:
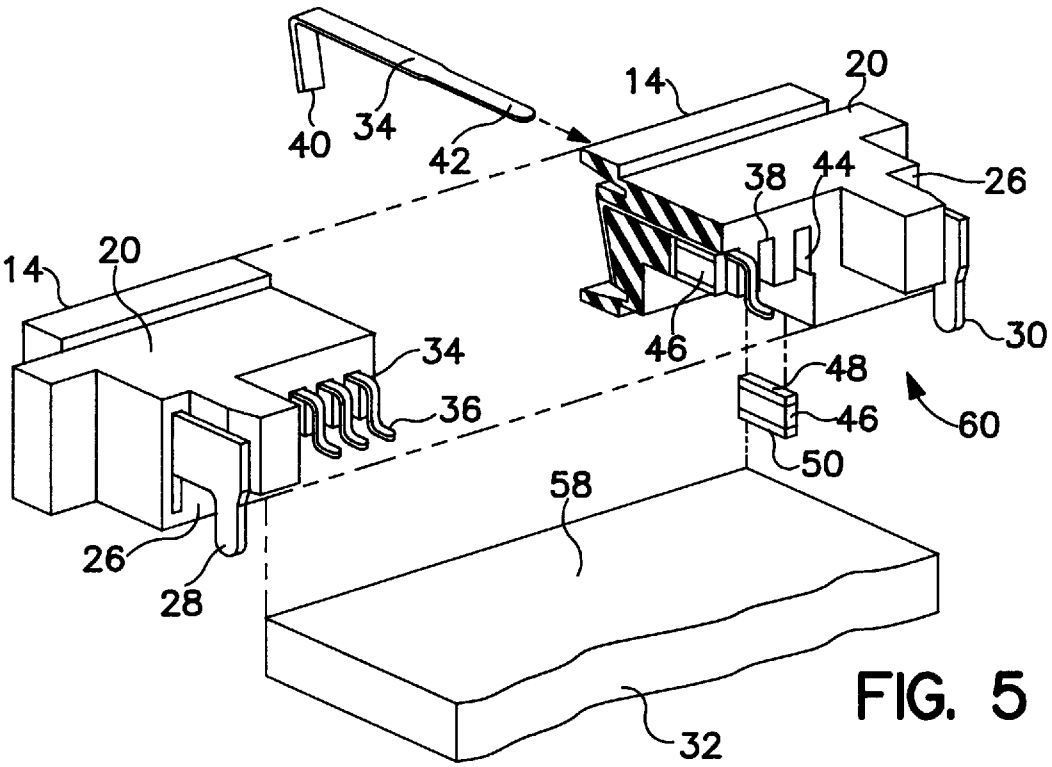
FIG. 5 is a perspective, broken away view of a portion of the connector of FIG. 1, in accordance with a second embodiment thereof in which the ground plane of the connector embodiment of FIGS. 3 and 4 is eliminated.
Figure 6:
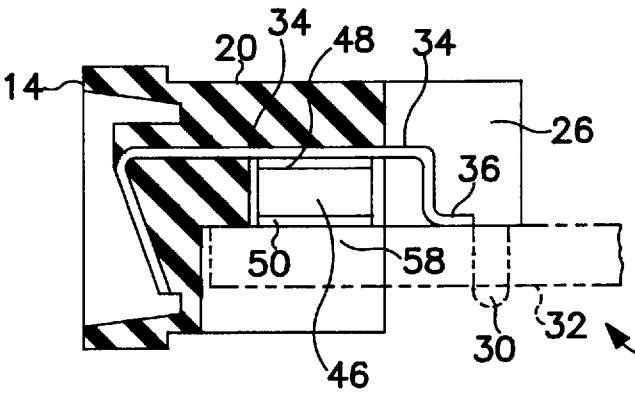
FIG. 6 is an end view of the connector of FIG. 5.

FIGS. 5 and 6 show an alternative embodiment of a connector 60 in accordance with the invention. The connector 60 of FIGS. 5 and 6 is like the connector 10 shown in FIGS. 3 and 4, except that the ground plane member 52 of FIGS. 3 and 4 is eliminated. Otherwise, like components are numbered using the same numbers as in the case of the connector 10 of FIGS. 3 and 4.

Referring to FIGS. 5 and 6, the contacts 34 are installed in the apertures 38, and the electronic components 46 are installed in the cavities 44, in the same manner as in the case of the connector 10 of FIGS. 3 and 4. Also, the substrate 32 is mounted at the bottom of the body 20 so as to extend across a substantial portion of the length thereof, in similar fashion. Unlike the connector 10 of FIGS. 3 and 4, however, no ground plane member 52 is used. Instead, the lower terminals 50 of the electronic components 46 terminate directly on the grounding portion 58 at the upper surface of the substrate 32. The lower terminals 50 are conductively bonded to the grounding portion 58 using appropriate bonding means such as soldering, conductive adhesive, conductive epoxy, or the like.

As in the case of the connector 10 of FIGS. 3 and 4, the substrate 32 of the connector 60 shown in FIGS. 5 and 6 defines a terminal member having one portion thereof, comprised of the grounding portion 58, which is electrically coupled to the lower terminals 50 of the electronic components 46, while other surface portions thereof are electrically coupled to the contact tails 36 of the contacts 34. In the case of both the connector 10 of FIGS. 3 and 4 and the connector 60 of FIGS. 5 and 6, the grounding portion 58 of the substrate 32 is grounded so as to ground the lower terminals 50 of the electronic components 46, in order to achieve grounded circuit configurations such as those shown in FIGS. 7 and 8 and described hereafter. However, in certain instances, the circuit configuration may call for the lower terminals 50 of the electronic components 46 to be coupled to other than ground, and in that event the portion 58 of the substrate 32 is not electrically grounded but rather is connected otherwise, so that desired circuit interconnections can be achieved. Also, while a substrate 32 in the form of a PC board is shown and described in connection with the connector 10 of FIGS. 3 and 4 and the connector 60 of FIGS. 5 and 6, other terminal members can be used in accordance with the invention. Examples of such members include a cable or a flex circuit. In any event, either the ground plane member 52 in the case of FIGS. 3 and 4 or the lower terminals 50 of the electronic components 46 in the case of FIGS. 5 and 6 are directly coupled by conductive bonding to the terminal member.

FIGS. 7 and 8 show two different grounded circuit configurations which can be achieved by the connector 10 of FIGS. 3 and 4 and the connector 60 of FIGS. 5 and 6. The circuit configuration of FIG. 7 is a simple capacitive filter or "C-filter" configuration in which the circuit path provided by each contact 34 is grounded through an electronic component 46 comprising a capacitor 62 of appropriate value. In the circuit arrangement of FIG. 8, the contact 34 is coupled to ground through an electronic component 46 in the form of a varistor component 64.

The component 64 can be a Transguard or a Staticguard, which are trademarks of AVX Corporation of Myrtle Beach, S.C., used to identify forms of metal oxide varistors (MOV). Transguard MOVs are capable of relatively high currents, and are suited for electromagnetic pulse (EMP) applications. Staticguard MOVs are capable of relatively high voltages, and are suited for electrostatic discharge (ESD) applications.

In the cases of the connector 10 of FIGS. 3 and 4 and the connector 60 of FIGS. 5 and 6, each of the contacts 34 extends outwardly from the rear 26 and ends in a contact tail 36 which terminates on the substrate 32. This is necessary in order to achieve certain circuit configurations such as those shown in FIGS. 7 and 8. However, still other circuit configurations, such as those shown and to be described hereafter in connection with FIGS. 10–12, require only a single circuit path extending through the electronic component 46. In such circuit configurations, the contact tails 36 of the contacts 34 are eliminated.

Such an embodiment, in the form of a connector 66, is shown in FIG. 9. The connector 66 of FIG. 9 is like the connector 60 of FIGS. 5 and 6, except for the elimination of the contact tails 36. As shown in FIG. 9, each contact 34 extends through an associated contact aperture 38 in the body 20, and then terminates at the rear 26 of the body 20. Consequently, the circuit path extends from the front portion 40 of the contact 34 to the intermediate portion of the contact 34 which directly contacts and is conductively bonded to the upper terminal 48 of the electronic component 46. The opposite lower terminal 50 of the electronic component 46 is in direct contact with and conductively bonded to a surface portion of the substrate 32, much in the same manner as the lower terminals 50 are directly coupled to the grounding portion 58 in the embodiment of FIGS. 5 and 6. In the case of the connector 66 of FIG. 9, however, a portion 68 of the substrate 32 at the surface thereof in direct contact with the lower terminal 50 of the electronic component 46 is not grounded.

FIGS. 10–12 provide examples of circuit configurations that can be implemented using the connector 66 shown in FIG. 9. FIG. 10 shows a series capacitance circuit in which the contact 34 is coupled through a capacitor 70 to the portion 68 of the substrate 32. The capacitor 70 is formed by the electronic component 46. In the example of FIG. 11, the contact 34 is coupled to the portion 68 through a resistor 72, to form a series resistance circuit. The resistor 72 is provided by the electronic component 46. In the example of FIG. 12, the contact 34 is coupled to the portion 68 through an inductor 74, forming a series inductance circuit. The inductor 74 is provided by the electronic component 46.

Figure 13:
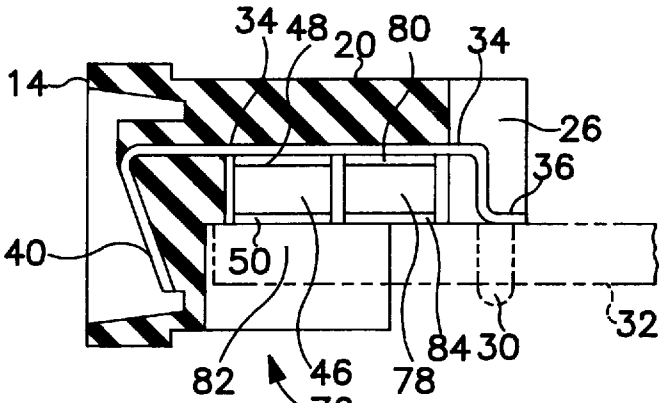
FIG. 13 is an end view of a connector embodiment which is similar to that shown in FIG. 6, but with the single electronic components being replaced by pairs of electronic components.

FIG. 13 shows a connector 76 in accordance with a further embodiment of the invention. The connector 76 of FIG. 13 is like the connector 10 of FIGS. 3 and 4, except that two of the electronic components are placed within each cavity 44 in the body 20. In addition to the electronic component 46, a second electronic component 78 is placed within each of the cavities 44. Consequently, the cavity 44 must be approximately twice as deep, within the body 20, as the cavity 44 in the case of the connector 10 of FIGS. 3 and 4. The body 20 has greater thickness between the front 14 and the rear 26, to accommodate the cavities 44 of greater size. The intermediate portion of the contact 34 is longer than in the case of the contacts 34 of FIGS. 3 and 4, because of the greater thickness of the body 20 between the front 14 and the rear 26. This enables the portion of each contact 34 extending from the rear 26 of the body 20 to be bent into a contact tail 36 which makes direct contact with the upper surface of the substrate 32 in the manner of the connector 10 of FIGS. 3 and 4 and the connector 60 of FIGS. 5 and 6. The upper terminal 48 of the electronic component 46 directly contacts and is conductively bonded to the intermediate portion of the contact 34. In similar fashion, an upper terminal 80 of the second electronic component 70 makes direct contact with and is conductively bonded to the intermediate portion of the contact 34. The substrate 32 has an upper surface portion 82 thereof which is grounded. The surface portion 82 extends under and in contact with both the lower terminal 50 of the electronic component 46 and a lower terminal 84 of the second electronic component 78, to ground both electronic components 46 and 78.

Figure 14:
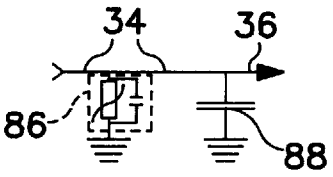
FIG. 14 is a schematic circuit diagram of the connector of FIG. 13, when provided with a varistor component and a capacitor so as to form a combination circuit as shown.

FIG. 14 is an example of a circuit configuration that can be implemented using the connector 76 of the embodiment of FIG. 13. In the example of FIG. 14, the electronic component 46 of FIG. 13 comprises an MOV component 86, such as a Transguard or a Staticguard. The second electronic component 78 comprises a capacitor 88. The MOV component 86 is serially coupled between the contact 34 and ground. At the same time, the capacitor 88 is coupled to form a separate serial path between the contact 34 and ground.

Figure 16:
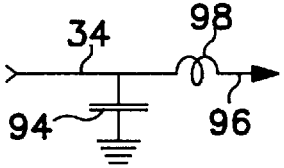
FIG. 16 is a schematic circuit diagram of the connector of FIG. 15, when provided with a capacitor and an inductor so as to form a combination circuit as shown.
Figure 15:
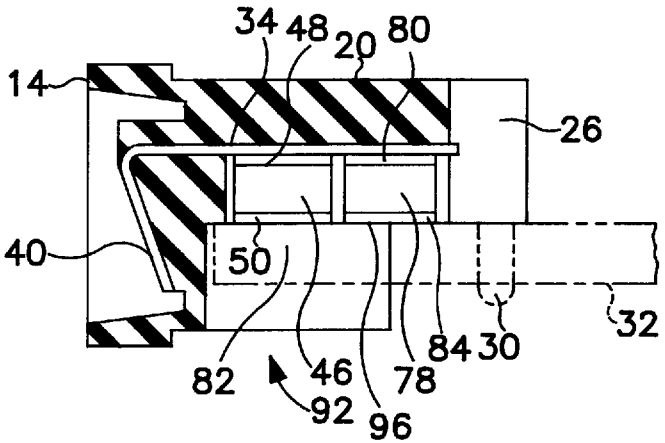
FIG. 15 is an end view of a connector embodiment which is similar to that shown in FIG. 9, but with the single electronic components being replaced by pairs of electronic components.

A connector 92 is shown by the further embodiment of FIG. 15. The embodiment of FIG. 15 is similar to that of FIG. 13, with a couple of exceptions. One difference is that the grounded surface portion 82 of the substrate 32 of FIG. 13 only extends beneath the lower terminal 50 of the electronic component 46. This forms a grounded capacitor 94 in the example of FIG. 16 which shows the circuit configuration of an L-filter. The first electronic component 46 forms the capacitor 94. Unlike the embodiment of FIG. 13, the lower terminal 84 of the second electronic component 78 is coupled to a surface portion 96 of the substrate 32 which is different from the grounded surface portion 82 and is not grounded. With the second electronic component 78 comprising an inductor 98, the inductor 98 is coupled between the contact 34 and the surface portion 96 of the substrate 32. Unlike the embodiment of FIG. 13, the contact 34 terminates at the rear 26 of the body 20 and does not form a contact tail 36.

While various forms and modifications have been suggested, it will be appreciated that the invention is not limited thereto but encompasses all expedience and variations falling within the scope of the appended claims.

What is claimed is:

1. A connector comprising the combination of:

an insulating body of elongated configuration between opposite ends thereof and having a front at one side thereof and a rear at an opposite side thereof, a plurality of contact slots extending through the body between the front and rear thereof, the contact slots being disposed in spaced-apart relation along the direction of elongation of the body between the opposite ends thereof, the rear of the body defining a component receiving area adapted to receive a plurality of electrical components;

a thin and substantially planar terminal member made of a conductive material, said terminal member being mounted on a lower portion of the body thereby bounding the component receiving area;

a plurality of contacts mounted within the body in respective of the contact slots; and a plurality of electrical components mounted within the component receiving area of the body, and each of the electrical components having opposite terminals in direct contact with the terminal member and with a different one of the plurality of contacts and thereby being electrically connected between the respective contact and the terminal member.

2. A connector in accordance with claim 1, wherein one of the opposite terminals of each of the electrical components is conductively bonded to an associated one of the plurality of contacts.

3. A connector in accordance with claim 2, wherein the conductive bonding comprises solder.

4. A connector in accordance with claim 2, wherein a second one of the opposite terminals of each of the electrical components is conductively bonded to the terminal member.

5. A connector in accordance with claim 1, wherein the connector has a generally planar substrate mounted on the body adjacent to the plurality of electrical components opposite the plurality of contacts.

6. A connector in accordance with claim 5, wherein each of the plurality of contacts has a tail portion thereof which extends into contact with and is conductively bonded to the substrate.

7. A connector in accordance with claim 5, wherein the terminal member comprises a ground plane conductively bonded to the substrate, said tail portions terminating on the substrate at a location substantially coplanar with the ground plane.

8. A connector in accordance with claim 7, wherein the ground plane has a plurality of compliant beams extending therefrom opposite the substrate and into contact with the second ones of the opposite terminals of the electrical components.

9. A connector in accordance with claim 5, wherein a portion of the substrate forms the terminal member.

10. A connector comprising the combination of:

an insulating body of elongated configuration between opposite ends thereof and having a front at one side thereof and a rear at an opposite side thereof, a plurality of contact slots extending through the body between the front and the rear thereof, the contact slots being disposed in spaced-apart relation along a direction of elongation of the body between the opposite ends thereof, and a plurality of cavities integrally defined in the insulating body at the rear thereof and each extending downwardly from a different one of the contact slots to a lower end of the body;

a thin and generally planar ground plane mounted on a lower portion of the body and having a upper surface thereof adjacent to the lower ends of the plurality of cavities;

a plurality of elongated contacts mounted in the contact slots and extending from the front of the body where they form a contact bank to the rear of the body; and a plurality of electrical components disposed in the plurality of cavities and having upper terminals thereof in direct contact with the plurality of contacts and lower terminals thereof in direct contact with the upper surface of the ground plane and thereby being electrically connected between the respective contact and the terminal member.

11. A connector in accordance with claim 10, wherein the electrical components are conductively bonded to the plurality of contacts at the upper terminals thereof and to the ground plane at the lower terminals thereof.

12. A connector in accordance with claim 11, wherein each of the conductive bondings comprises solder.

13. A connector in accordance with claim 11, wherein each of the conductive bondings comprises conductive adhesive.

14. A connector in accordance with claim 10, wherein the plurality of contacts have intermediate portions thereof which are in direct contact with the upper terminals of the electrical components and which are generally parallel to the substrate.

15. A connector in accordance with claim 10, wherein the ground plane is disposed within slots defined in the body adjacent a lower end of the cavities and being perpendicular thereto, an upper surface of the ground plane being in direct contact with the lower terminals of the plurality of electrical components.

16. A connector in accordance with claim 15, wherein the ground plane has compliant beams in direct contact with the lower terminals of the plurality of electrical components.

17. A connector in accordance with claim 10, wherein the ground plane is conductively bonded to the lower terminals of the plurality of electrical components and to an underlying substrate.

18. A connector in accordance with claim 10, wherein each of the plurality of electrical components is of generally rectangular configuration between a relatively flat upper terminal thereof and an opposite relatively flat lower terminal thereof.

19. A connector in accordance with claim 10, wherein the contacts extend outwardly and downwardly from the rear of the body and terminate in contact tails which are in direct contact with a substrate underlying the ground plane.

20. A connector in accordance with claim 19, wherein the contact tails are conductively bonded to the substrate.

21. A connector comprising the combination of:

a body having a plurality of contact apertures therein and a plurality of cavities extending from portions of the contact apertures to opposite open ends thereof;

a thin and substantially flat ground plane mounted on the body and having an upper surface thereof disposed adjacent the open ends of the cavities;

a plurality of contacts mounted in the contact apertures in the body; and a plurality of electronic components, each being disposed in a different one of the plurality of cavities and having a first terminal at one end thereof soldered to an adjacent one of the contacts and an opposite second terminal at an opposite end thereof soldered to the upper surface of the ground plane.

22. A connector in accordance with claim 21, wherein the plurality of contacts terminate in tails which extend into contact with and are soldered to a substrate underlying the ground plane.

23. A connector in accordance with claim 22, wherein the plurality of electronic components comprise capacitors.

24. A connector in accordance with claim 22, wherein the plurality of electronic components comprise varistor components.

25. A connector in accordance with claim 21, wherein the plurality of electronic components comprise capacitors.

26. A connector in accordance with claim 21, wherein the plurality of electronic components comprise resistors.

27. A connector in accordance with claim 21, wherein the plurality of electronic components comprise inductors.

28. A connector in accordance with claim 21, wherein the plurality of contacts terminate in tails which extend into contact with and are soldered to a substrate underlying the ground plane, the plurality of electronic components comprise varistor components, and further including a plurality of capacitors, each being disposed in one of the plurality of cavities adjacent one of the varistor components and having a first terminal at one end thereof soldered to an adjacent one of the contacts and an opposite second terminal at an opposite end thereof soldered to the ground plane.

29. A connector in accordance with claim 21, wherein the plurality of electronic components comprise capacitors, and further including a plurality of inductors, each being disposed in one of a plurality of cavities adjacent one of the capacitors and having a first terminal at one end thereof soldered to an adjacent one of the contacts and an opposite second terminal at an opposite end thereof soldered to the ground plane.

* * * * *